United States Patent [19]

Terasaki

[11] Patent Number: 4,841,995

[45] Date of Patent: Jun. 27, 1989

[54] TAR REMOVING CIGARETTE HOLDER

[76] Inventor: Masahiro Terasaki, 43, Okimiya-cho, Edogawa-ku, Tokyo, Japan

[21] Appl. No.: 130,171

[22] Filed: Dec. 8, 1987

[30] Foreign Application Priority Data

Dec. 23, 1986 [JP] Japan ..... 61-197996[U]

[51] Int. Cl.[4] ..... A24D 3/04

[52] U.S. Cl. ..... 131/212.1; 131/212.2; 131/213; 131/216

[58] Field of Search ..... 131/336, 338, 339, 340, 131/210, 212.1, 212.2, 213

[56] References Cited

U.S. PATENT DOCUMENTS 3,601,133 8/1971 Van Eck et al. .

3,877,470 4/1975 Jewett et al. .

FOREIGN PATENT DOCUMENTS 0054613 6/1982 European Pat. Off. .

OTHER PUBLICATIONS

PCT International Appln No. PCT/US80/01646–published 6–81.

*Primary Examiner*—V. Millin

*Attorney, Agent, or Firm*—Stevens, Davis, Miller & Mosher

[57] ABSTRACT

A tar removing cigarette holder assembled of a body having a cylindrical bore and a cup portion formed integrally therewith and located in the bore, the cup portion being open toward one end of the bore and defining a first annular space with the bore wall and having at least one partial cut away at the annular open edge thereof and a closed end wall portion, a mouthpiece member attached to the other end of the body, and a partition member inserted into the bore with an annular disk portion tightly engaged with the bore wall so as to close the open end of the cup portion and a central tubular projection extended into the cup portion and defining a second annular space with the cylindrical wall portion of the cup portion, the first and second annular spaces being in communication through the cut away of the cup portion.

2 Claims, 1 Drawing Sheet

TAR REMOVING CIGARETTE HOLDER

BACKGROUND OF THE INVENTION

The present invention relates to a tar removing cigarette holder for smoking.

It is well known to provide a cigarette holder with a tar removal cartridge which eliminates tar constituents from tobacco smoke or a tar elimination cigarette holder which has a directly built in tar removal construction. As such tar removing construction an impact type tar removal construction is known, wherein tobacco smoke impacts at a high speed on a wall so that the tar constituents within the smoke are made to adhere onto the surface of the wall and are thus removed from the smoke. Various tar removing structures according to this principle have also been proposed. However, the problem still remains with regard to how the smoke impacting and tar removing structure is constructed more effectively at lower costs of manufacture.

SUMMARY OF THE INVENTION

The object of the present invention is to provide a tar removal cigarette holder having high tar removing performance and yet has highly good production characteristics with few assembly problems, whereby a stable and high product quality can be achieved at low manufacturing costs.

The above object is achieved, according to the present invention, by a tar removing cigarette holder comprising a body having a cylindrical bore serving at one end portion thereof as a cigarette attachment aperture and a cup portion formed integrally therewith and located in said bore, said cup portion being open toward said cigarette attachment aperture with a cylindrical wall portion defining a first annular space with a wall surface of said bore and having at least one partial cut away at an annular open edge portion thereof and a closed end wall portion, a mouthpiece member attached to another end portion of said body opposite to said cigarette attachment aperture, and a partition member inserted into said bore with an annular disk portion thereof being tightly engaged with the wall surface of said bore so as to close the open end of said cup portion and a central tubular projection thereof being inserted into said cup portion with a free end thereof spaced from the end wall portion of said cup portion and defining a second annular space with said cylindrical wall portion of said cup portion, said first and second annular spaces being in communication through said cut away of said cup portion.

According to the above construction, since the cup portion is formed integrally with the body, as manufactured by, for example, injection molding of a synthetic resin material, the tar removal device is completed simply by inserting the partition member into the bore of the body. Since the cup portion may be integrally connected with a cylindrical portion of the body by bridge portions, a two-part mold injection molding of a synthetic resin can provide a product of stable dimensional accuracy at stable quality and low production costs.

BRIEF DESCRIPTION OF THE DRAWING

The present invention will now be described in detail in terms of an embodiment with reference to the attached drawings, wherein.

DESCRIPTION OF THE PREFERRED EMBODIMENT

Figure 1:
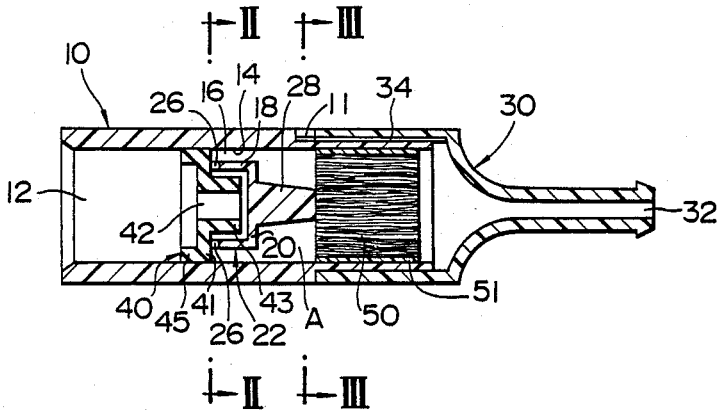
FIG. 1 is a longitudinal sectional view of an embodiment of a tar removal cigarette holder according to the present invention.
Figure 2:
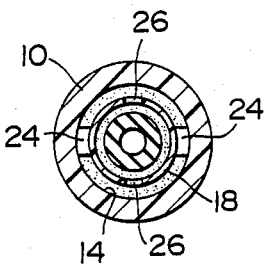
FIG. 2 is a sectional view along line II—-II in FIG. 1.
Figure 3:
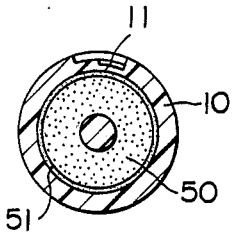
FIG. 3 is a sectional view along line III—III in FIG. 1.

In these drawings, 10 is a body of a generally cylindrical construction which has a cylindrical bore 14 which serves at one end thereof as a cigarette attachment aperture 12, and 30 is a mouthpiece member attached to the other end of the body 10 and having a mouthpiece opening 32 at the end remote from the end portion connected to the body 10.

The body 10 is formed, as located in the bore 14, with a cup portion 22 as integrally formed therewith to have a annular wall portion 18 which defines an annular space 16 with the inner surface 14 of the bore and an end wall portion 20 which closes the end portion of this cylindrical wall portion to form the cup portion opened toward the cigarette attachment aperture 12. The wall portion 18 is connected with the cylindrical portion of the body 10 by a pair of bridge portions 24 which extend radially across the annular space 16.

The cylindrical wall portion 18 is partially cut away at its open edge portions as cut way 26, as arranged in the shown embodiment with a circumferential spacing of 180 degrees. Further, a leg portion 28 is provided to extend from the end wall portion 20 in the shown embodiment.

The body 10 having the cup portion 22 formed integrally therein is made completely by a single operation of synthetic resin injection molding using an injection mold which is split into two parts to the left and the right as seen in FIG. 1 and joining at the bridge portions 24. The cut away portions 26 are also formed at the same time.

A partition member 40 made of rubber or a soft synthetic resin is inserted into the bore 14 past the cigarette insertion aperture 12 with its disk portion 41 as engaged at its annular flange portion 45. The disk portion 41 adjoins the end rim of the annular wall portion 18 and closes the open end of the cup portion 22, while defining orifice passages at the cut away portions 26. The partition member 40 has a central tubular projection 43 which has a smoke conducting passage 42 and ends as spaced from the end wall portion 20 of the cup portion 20 and defines an annular space with the annular wall portion 18 of the cup portion 22. This annular space operates to hold a static pressure of the smoke for ejecting it through the orifice passages.

Within the end portion of the bore 14 opposite to the cigarette attachment aperture 12, there is inserted a fibrous or porous filter element 50 having a cylindrical surface layer 51. The filter element 50 abuts against the leg portion 28 of the cup portion 22, whereby the amount of insertion of the filter element 50 into the bore 14 is restricted, and thereby a tar collection chamber A of a sufficient volume is provided between the cut away portions 26 and the filter element 50.

The body 10 and the mouthpiece member 30 are arranged so that one fits removably inside the other, and they are mutually rotatable, and by selectively aligning an air intake concavity 11 provided at a portion of the outer periphery of the body 10 with an air intake groove 34 formed on the inner periphery of the mouthpiece member 30, an addition of air to the smoke within the cigarette holder is effected.

To use a tar removal cigarette holder of the above construction, a cigarette is inserted by one end in the cigarette attachment aperture 12, a light is applied to the other end of the cigarette and a suction force is applied to the mouthpiece 32 of the mouthpiece member 30. Thus the smoke of the cigarette passes through the smoke through passage 42 to the inside of the annular wall 18 of the cup portion 20, and then flows through the orifice passages provided by the cut away portions 26 into the annular space 16. At this point, by the throttling effect by the orifice passages the flow speed of the smoke is increased, and the flow hits the inner surface of the bore 14 of the body 10 at high speed. The smoke here undergoes an immediate change of direction, and flows axially along the annular space 16 toward the mouthpiece member 30, while the tar constituents in the smoke impact on the inner surface of the bore 14 because of their inertia, and are trapped adhering onto the inner surface by their stickiness, and thus accumulate in the tar constituent accumulation chamber A.

In the above, the present invention has been described in detail in terms of a particular embodiment, but the present invention is not limited to this, and it will be clear to those skilled in the relevant art that various modifications are possible within the scope of the invention.

I claim:

1. A tar removing cigarette holder comprising a body including a tubular portion having a cylindrical bore serving at one end portion thereof as a cigarette attachment aperture and a cup portion formed integrally with said tubular portion and located in said bore and being supported from said tubular portion via integral bridge portions, said cup portion being open toward said cigarette attachment aperture with a cylindrical wall portion thereof defining a first annular space with a wall surface of said bore and having at least one partial cut away at an annular open edge portion thereof and a closed end wall portion, a leg projection extending from said closed end wall portion; a mouthpiece member attached to a second end portion of said body opposite to said cigarette attachment aperture, a filter element mounted in said cylindrical bore and inserted therein from said second end so as to abut against a free end of said leg projection; and a partition member inserted into said bore with an annular disk portion thereof being tightly engaged with the wall surface of said bore so as to close the open end of said cup portion and a central tubular projection thereof being inserted into said cup portion with a free end thereof spaced from the closed end wall portion of said cup portion and defining a second annular space with said cylindrical wall portion of said cup portion, said first and second annular spaces being in communication with one another through said cut away of said cup portion.

2. A tar removing cigarette holder according to claim 1, wherein said bridge portions are provided as a pair at radially opposite sides of said cup portion, and said cut away is located substantially equally angularly shifted from said pair of bridge portions.

* * * * *